United States Patent [19]

Martin

[11] 4,376,536

[45] Mar. 15, 1983

[54] GOLD CLUB GRIP CONFIGURATION

[76] Inventor: Harry L. Martin, 1878 Pomar Way, Walnut Creek, Calif. 94598

[21] Appl. No.: 285,779

[22] Filed: Jul. 21, 1981

[51] Int. Cl.[3] ..... A63B 53/14

[52] U.S. Cl. ..... 273/81.4

[58] Field of Search ..... 273/72 R, 73 J, 75, 273/81 R, 81 B, 81 D, 81.4–81.6, 165, 67 DA

[56] References Cited

U.S. PATENT DOCUMENTS

| | | | |
|---|---|---|---|
| 1,075,054 | 10/1913 | Morley | 273/165 |
| 1,638,454 | 8/1927 | Papin | 273/81.4 |
| 1,822,212 | 9/1931 | Griffiths | 273/81.4 |
| 2,092,839 | 9/1937 | Gouverneur | 273/81.4 |
| 2,141,519 | 12/1938 | Cunningham et al. | 273/81.4 |
| 2,873,970 | 2/1959 | Murphey, Jr. | 273/81.3 |
| 3,880,443 | 4/1975 | Tobin | 273/81 D X |
| 3,995,856 | 12/1976 | Hollendorfer | 273/81 R X |

FOREIGN PATENT DOCUMENTS

| | | | |
|---|---|---|---|
| 27827 | of 1897 | United Kingdom | 273/81.4 |
| 435048 | 9/1935 | United Kingdom | 273/81.4 |

*Primary Examiner*—George J. Marlo

*Attorney, Agent, or Firm*—Phillips, Moore, Lempio & Finley

[57] ABSTRACT

A conical golf club grip for golf clubs with conventional shaft and head designs, the grip having a configuration designed to properly orient the upper hand of the user with respect to the club head and maintain the fingers firmly against the club grip throughout the backswing and follow-through, the grip having a button-hook style boss at the cap end of the grip with a downwardly directed end projection, such that there is formed a curved crotch against which the small finger of the upper hand is seated, wherein the crotch is defined in part by a straight slanted cut in the surface of the conical club grip opposite the end projection and directed toward the crotch forming a flat surface against which the end of the user's fingers can comfortably seat and automatically define a proper orientation of the club and club head with respect to the user's hands preparatory to swinging the club.

3 Claims, 4 Drawing Figures

FIGURE 1
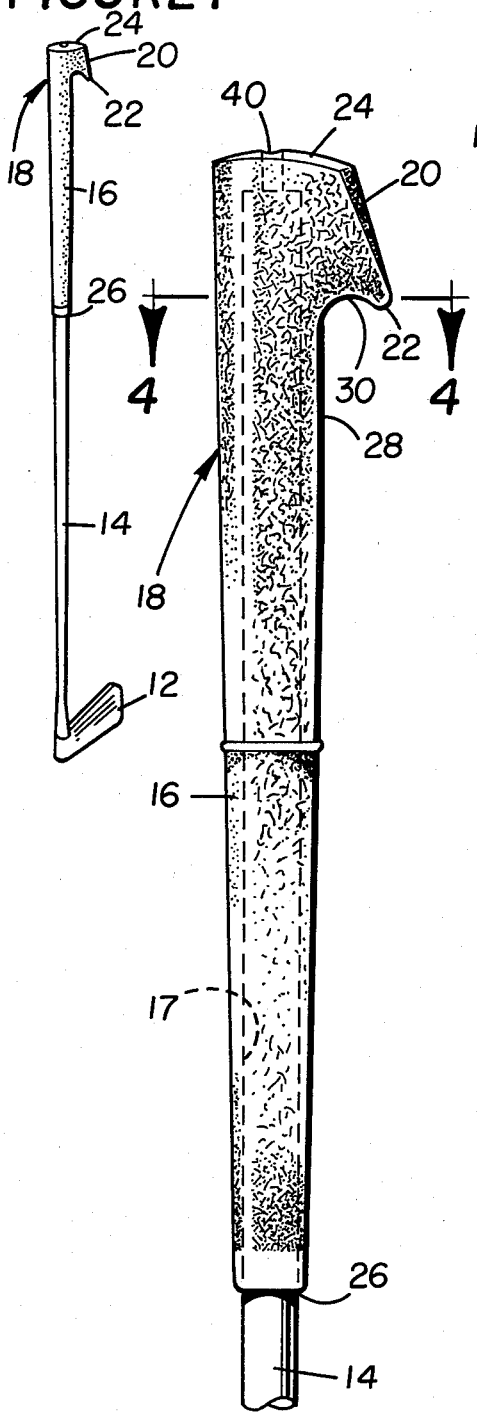
FIGURE 2
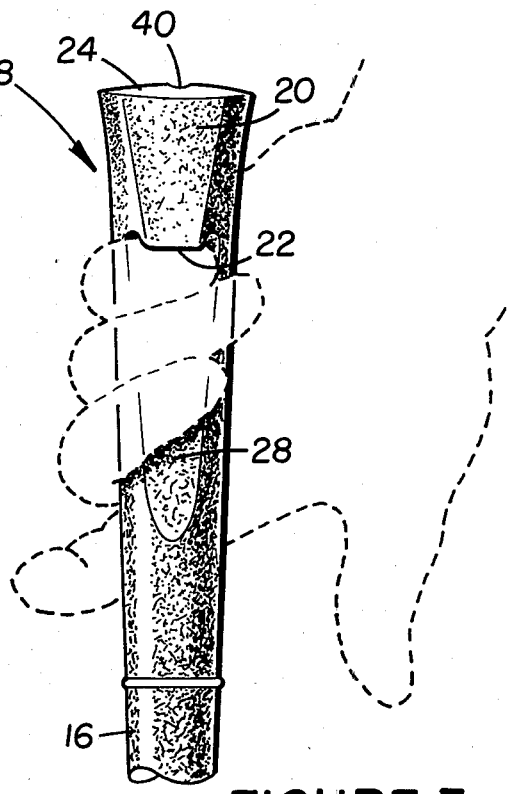
FIGURE 3
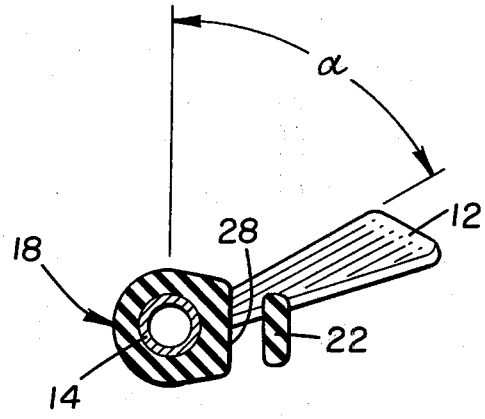
FIGURE 4

GOLD CLUB GRIP CONFIGURATION

BACKGROUND OF THE INVENTION

This invention relates to an improved golf club grip and more specifically relates to a grip configuration at the cap end of the grip which is designed to improve the user's game by correcting improper practices common to many golfing enthusiasts.

Golf club grips in the past have simply comprised a substantially cylindrical composition material over the shaft having a slight taper or narrowing in diameter from the cap end of the grip to the juncture of grip and exposed shaft to form a cone. In some instances the grip is enlarged at the cap end in excess of the gradual taper to inhibit slippage of the club resulting from the dynamic centrifugal forces generated during a swing.

The conventional design has certain disadvantages. The uniform, round cross section of the grip provides no indicia to allow the user to feel whether the club is properly oriented in his hand; thus the grip must be adjusted visually with reference to the club head. Further, it is difficult to overcome the centrifugal force that is developed during the golf swing except by tightening the grip, often to the point where the desired fluidity of motion is inhibited.

In the worst case, if a tight grip is not maintained, there can actually be an inadvertent release of the club from the user's hands, which is a danger to those playing in the vicinity of the user. Most importantly, conventional clubs have no means of inhibiting the improper practice of loosening the grip, particularly at the little finger and ring finger of the upper hand on the club during backswing and follow-through.

The golf club grip of this invention is designed to be used on all of the clubs in the user's club set such that the user need not readjust his grip during a golf game, and further the user can use his clubs without the disadvantages of the unmodified clubs.

SUMMARY OF THE INVENTION

The golf club grip of this invention has a configuration at the cap end of the club grip that conforms naturally to the upper hand of the user, be he right or left handed, and provides a plurality of advantages over conventional grips. The grip has a button-hook style boss at the cap end of the grip. The boss includes a downwardly directed or depending end projection such that there is formed a curved crotch against which the small finger of the user's upper hand is seated. The crotch is also further defined by a straight slanted cut in the surface of the conical club grip, the cut being opposite the depending end projection. The cut is directed toward the curved crotch forming a gradually widening flat surface against which the ends of the user's fingers are comfortably seated.

This configuration results in certain inherent advantages. The flat surface in addition to providing a more comfortable natural orientation of the middle, ring and little fingers of the hand, provides a tactile means of orienting the hands on the grip with respect to the head of the club. This becomes natural and repeatable for the user with respect to all of the clubs in his set. The depending hook projection automatically locks the little finger and in part the ring finger firmly against the club grip throughout the backswing and follow-through. The curved crotch, against which the little finger is seated, provides a stop for the hand, again for a repeatable orientation of the hands of the user on the grip, but more importantly provides a stop for absorbing the centrifugal forces generated during the swing and prevents inadvertent release of the club.

The design of the grip is such that the grip can be used on either left or right handed clubs. The grip has a configuration that automatically prescribes the hand grip that is professionally taught, but difficult to otherwise maintain. These and other features will become apparent from the detailed description of the preferred embodiment.

BRIEF DESCRIPTION OF THE DRAWINGS

FIG. 1 is a perspective view of a golf club with a novel grip.

FIG. 2 is an enlarged side elevational view, partially fragmented, of the grip of FIG. 1.

FIG. 3 is a front elevational view, partially fragmented, of the grip of FIG. 2.

FIG. 4 is a cross sectional view taken on the lines 4—4 of FIG. 2.

DETAILED DESCRIPTION OF THE PREFERRED EMBODIMENTS

Referring to FIG. 1, a golf club, designated generally by the reference number 10, is shown. The club 10 comprises an exemplar iron, having a head 12, a shaft 14, and a grip 16. The club 10 is conventional in all respects except for the cap portion 18 of the grip, which has a boss 20 in the configuration of a button-hook for aiding in the controlled grip, swing and follow-through. The novel grip configuration can be employed on all of the woods and irons, including if desired on the putter, although its features are less significant when the grip is used on a putter.

Referring to the enlarged view of FIG. 2, the boss 20 at the cap portion of the grip includes a downwardly directed end projection 22 depending from a cap 24.

The grip 16 is frusto-conical, tapering slightly in diameter from the cap 24 which is at the base of the cone shape to the juncture 26 of grip 16 and shaft 14 and may be fabricated from a conventional rubber-like composition material. Grip 16 has a concentric bore 17 of sufficient size to snugly fit over a conventional golf club. Bore 17 is, of course, open at the juncture of the grip and shaft 14 while at cap end it is closed except for a vent hole 40 about which more will be said. At the cap portion 18 an incline cut into the conical surface of the grip forms a flat finger surface 28 which gradually widens until a transition to the curvature of a crotch 30, which is defined in part by the depending end projection 22 and the opposite flat finger surface 28. The crotch 30 is smoothly curved and adapted to seat at least the user's little finger. The incline cut may slope inwardly approximately ten degrees from a line parallel to the center axis of the grip and shaft or parallel the center axis.

Referring in addition to FIG. 3, the orientation of a user's hand, shown in phantom, is employed to assist in illustrating the adaptation of the cap portion of the grip to the hand of a right-handed user, preparatory to firmly gripping the club for addressing and swinging the club in proper form. The particular phantom illustration is adapted from one of the six illustrated stages in assuming the conventional overlapping grip of a golf club as presented by the *Encyclopedia Britannica,* (1968), under the topical heading GOLF. The hand grip is completed in the same manner as for a conventional club, however, the orientation of the hand is altered slightly by the inclined flat finger surface 28, and the seating for the little finger at the curved crotch 30. The feeling obtained by the user is natural and comfortable, and automatically orients the hand with respect to the club head 12 in the proper manner.

Referring to FIG. 4, the cross sectional views can provide an understanding of the configuration of the boss 20 and its axial position with respect to the club head 12. In FIG. 4, the axial position of the club head 12 with respect to the boss can be appreciated, the angle $\alpha$ between a reference line through the center axis of the substantially cylindrical club grip and shaft and parallel to the flat finger surface 28 shown as $\alpha$ in FIG. 4, being approximately 30–60 degrees depending on user preference.

The shaft 14 extends as a core within the grip 18 a shown in FIGS. 2 and 4. In order to permit fixture of the grip to a conventional club, a hole 40 is formed in cap 24. Hole 40 serves to release air entrapped in the grip as it is slipped onto the club shaft. The club grip can either be pie-fitted to the shaft at the factory or by the user to his personal specifications. The latter can be accomplished by either a local pro-shop or by providing the user with an appropriate grip adhesive to secure the grip to the shaft before use.

While in the foregoing specification embodiments of the present invention have been set forth in considerable detail for the purposes of making a complete disclosure of the invention, it will be apparent to those of ordinary skill in the art that numerous changes may be made in such details without departing from the spirit and principles of the invention.

I claim:

1. A golf club comprising a head, a shaft and a grip, said head affixed to said shaft at one end thereat and said grip fixable to said shaft at the other end of said shaft, said grip having a cap portion at the top of the club distal of said head with a button-hook style boss, said boss having a downwardly directed end projection defining a curved crotch, said crotch being adapted to seat the little finger of a user, the finger being partially restrained by said end projection for maintaining the fingers of the user in proper orientation to said club during said user's swing and follow-through; and further wherein said grip has a conical configuration tapering from the boss end toward the head end of said shaft; and further, said grip having a vent hole in said cap.

2. The golf club of claim 1 wherein said grip includes further a flat finger surface adapted for seating certain fingers of the user, said surface formed by a cut into said conical grip forming a gradually widening flat surface opposite said downwardly directed end projection, said surface defining a smooth transition to said curved crotch.

3. A conical shaped golf club grip having a cap portion at its base end, said cap portion formed with a button-hook style boss, said boss having a downwardly directed projection defining a curved crotch; said grip defining a flat surface adjacent said curved crotch, said flat surface smoothly transitioning into said crotch.

* * * * *

UNITED STATES PATENT AND TRADEMARK OFFICE

CERTIFICATE OF CORRECTION

PATENT NO. : 4,376,536

DATED : March 15, 1983

INVENTOR(S) : Harry L. Martin

It is certified that error appears in the above-identified patent and that said Letters Patent is hereby corrected as shown below:

In the Title: Change "Gold" to -- Golf --.

Signed and Sealed this

*Twenty-fourth* Day of *May 1983*

[SEAL]

*Attest:*

DONALD J. QUIGG

*Attesting Officer*

*Acting Commissioner of Patents and Trademarks*